United States Patent [19]

Farmer

[11] 4,194,737

[45] Mar. 25, 1980

[54] ERRATICALLY ROLLABLE GAME DEVICE

[76] Inventor: William R. Farmer, 215 Campbell St., New Westminster, British Columbia, Canada, V3M 5K8

[21] Appl. No.: 920,388

[22] Filed: Jun. 29, 1978

[51] Int. Cl.[2] ..... A63B 43/04

[52] U.S. Cl. ..... 273/58 BA; 273/58 F; 273/58 G; 273/65 R; 273/128 A; 46/241; 46/254

[58] Field of Search ..... 273/128 A, 58 BA, 58 F, 273/65 R, 138 R, 146, 142 JB, 143 C, 1 M, DIG. 20, 58 B, 58 G; 46/236, 254, 241, 242

[56] References Cited

U.S. PATENT DOCUMENTS

| | | | |
|---|---|---|---|
| 1,970,731 | 8/1934 | Boggess | 273/143 C |
| 2,524,546 | 10/1950 | Sinclaire | 273/DIG. 20 |
| 2,665,912 | 1/1954 | Juran | 273/1 M |
| 2,731,266 | 1/1956 | Neilson | 273/58 B X |
| 3,029,371 | 4/1962 | Saito | 46/254 X |
| 3,102,362 | 9/1963 | Neal | 46/236 |
| 3,303,821 | 2/1967 | Harris | 46/254 X |
| 3,400,932 | 9/1968 | Conrad | 273/146 |
| 3,679,212 | 7/1972 | Smith | 273/58 F X |
| 3,954,269 | 5/1976 | Brittingham | 273/138 R |
| 4,014,544 | 3/1977 | Kimura | 273/1 M X |

*Primary Examiner*—George J. Marlo
*Attorney, Agent, or Firm*—Richards, Harris & Medlock

[57] ABSTRACT

A hollow body encloses a spherical weight which rolls around the inner surface of the body as the body itself is rotated over a playing field. The inner surface of the body has magnetic inserts and the spherical weight is fitted with internal magnets having pole pieces which are flush with the surface of the weight. As the hollow body is rolled, the magnetic elements occasionally come into contact with one another to momentarily secure the weight to the inner surface and thereby alter the rolling characteristics of the body.

8 Claims, 7 Drawing Figures

ERRATICALLY ROLLABLE GAME DEVICE

The field of the invention is mainly classified in Class 273 and, to a lesser extent, in Class 46.

The most pertinent references known to applicant comprising the following United States patents;

U.S. Pat. No. 3,102,362—Neal
U.S. Pat. No. 2,665,912—Juran
U.S. Pat. No. 2,524,546—Sinclaire
U.S. Pat. No. 2,731,266—Neilson
U.S. Pat. No. 3,303,821—Harris
U.S. Pat. No. 4,014,544—Kimura
U.S. Pat. No. 3,029,371—Saito The present invention, like the devices disclosed by the first four patents listed above, relate to a ball having an unusual or unpredictable rolling action. As taught by these references, it is not uncommon to fit a hollow ball with an internal magnet so that when the ball is rolled along the flat surface of a game board fitted with magnetizable pieces, the rolling action of the ball will be influenced by magnetic attraction. In the Juran patent, for example, it is suggested that the magnet be contained within an inner ball which is rollable inside an outer ball but a magnetic board is still required for the patented game. The suggestion has been made in the last three patents listed above that toys and the like be remotely controlled by radio in somewhat the same manner as the ball of the present invention is controlled. However, this invention differs principally from all the known prior art in that one embodiment contemplates a plaything comprising an inner and outer ball having magnetic elements on their contacting surfaces. These elements are magnetically attracted to one another in a haphazard manner as the outer ball is propelled across a playing field having a conventional grass or other non-magnetic surface and the resulting strange behaviour of the ball is due entirely to the action of the internal magnetic elements. In another embodiment of the same invention, some of the magnetic element are electromagnets which are included in a circuit capable of being controlled from a remote point by radio signals. Thus, the operator of the signalling device can control to some extent at least the time and place when the inner ball is magnetically held against rotation within the outer ball.

Figure 1:
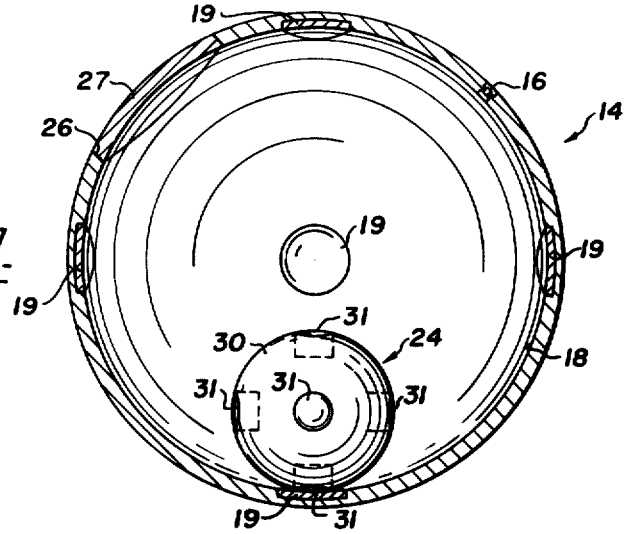
Figure 2:
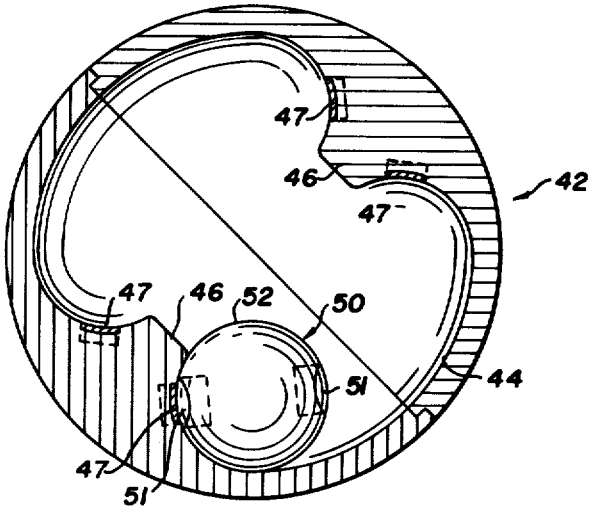
Figure 3:
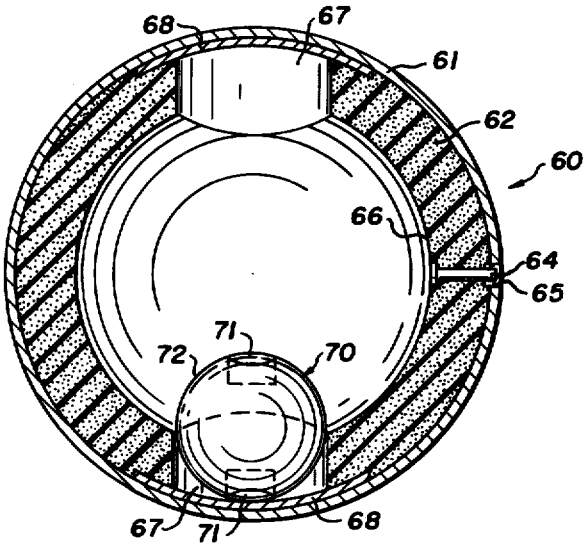
Figure 4:
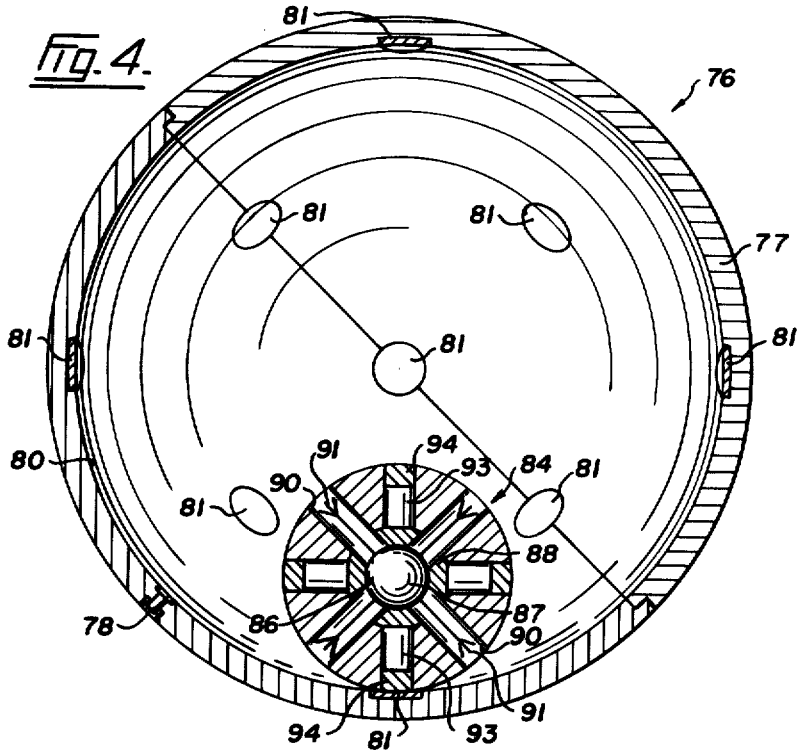
Figure 5:
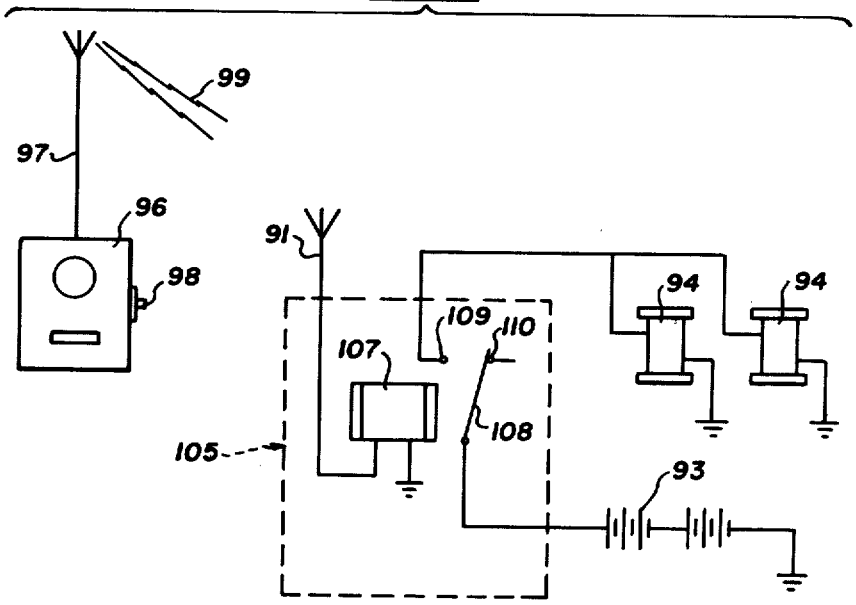
Figure 6:
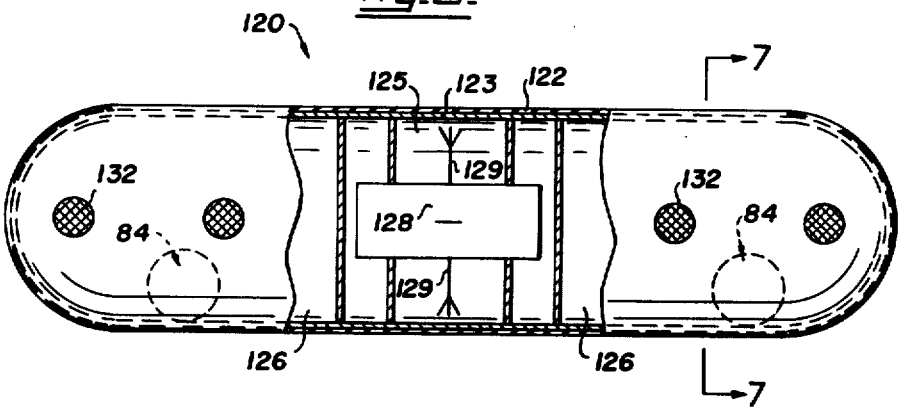
Figure 7:
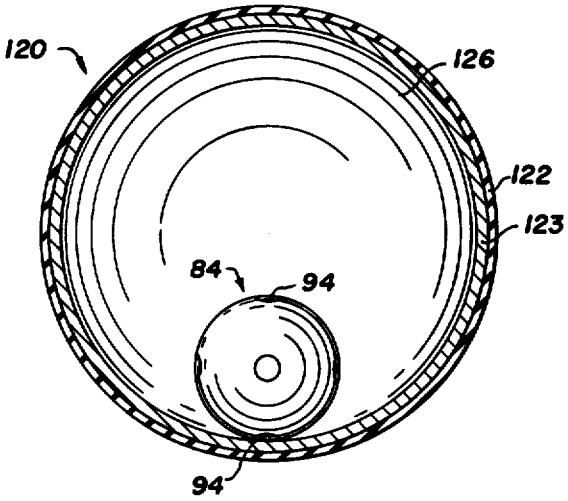

In drawings which illustrate preferred embodiments of the present invention,

FIG. 1 is a cross sectional view of a plaything constructed in accordance with one embodiment of the present invention, FIG. 2 is a similar view of another embodiment thereof, FIG. 3 is also a cross sectional view of still another embodiment thereof, FIG. 4 is a similar view of a still another further embodiment thereof, FIG. 5 is a diagram showing a simplified form of remote control means for providing a measure of control over the rolling movement of the embodiments shown in FIGS. 4, 6 and 7, FIG. 6 is a front elevation, part broken away and shown in section, of still another embodiment of the invention, and FIG. 7 is an enlarged transverse section taken on the line 7—7 of FIG. 6.

FIG. 1 of the drawings, illustrates a plaything which is intended to be pushed or otherwise propelled over a surface of a playing field by a team of players opposed by another team. Such a plaything may be some six feet or more in diameter if it is primarily intended to be pushed, or may be up to 2 feet in diameter when it is intended to be propelled otherwise.

The plaything comprises a hollow body in the form of a ball 14 which has a peripheral wall 15 preferably made of a flexible material such as plastic or rubber. A valve 16 is fitted to the wall 15 so that the ball 14 can be inflated with air or a suitable buoyant gas to a pressure which will make the wall reasonable firm yet slightly resilient. The wall 15 has an inner surface 18 and, suitable secured to this surface, are inserts 19 formed of a magnetic material such as iron. The spacing of the inserts 19 about the inner surface 18 is desirably as shown in FIG. 1 although additional spaced-apart inserts may be used.

Enclosed within the ball 14 is another ball 24. The relatively small and heavy inner ball generally indicated at 24 is inserted through an opening 26 formed in the wall 15, the opening then being sealed by a plug 27. The weighted ball 24 is intended to roll about the inner surface 18 of the outer ball whenever the latter ball is propelled over the playing field. However, this rolling movement is not completely free or unrestricted since the inner ball 24 has a peripheral surface 30 on which at least two diametrically opposed permanent magnets 31 appear. As indicated in FIG. 1, preferably six such magnets 31 are mounted within the inner ball and those magnets are equidistantly spaced apart to extend radially outwards from the center of the ball. It will be appreciated that the magnets 31 could be on the surface 18 and the inserts 19 could be carried by the inner ball.

The small and heavy ball 24, of course, lowers the center of gravity of the larger ball 14 and makes it harder to roll than otherwise would be the case. When rolling motion is imparted to the ball 14, the small ball continuously shifts its position and therefore the plaything does not move in a manner of a normal or properly balanced ball. As the plaything 14 is moved back and forth over a playing field by two opposing teams, the rolling action of the device will be found to be erratic and unpredictable which should make the game more interesting. At times, a greater-than-usual amount of effort is required to roll the plaything forward and at other times the slowly rolling device will accelerate on its own with both such actions being attributable to the rolling movements of the small and heavily weighted inner ball. The small ball 24 rolls about the inner surface 18 of the large ball 14 and occasionally a magnet 31 will come into direct contact with a magnetic insert 19 and may affix itself thereto. This will reduce the momentum of the rolling device and might cause it to jump slightly or will cause it to adopt a loping movement or otherwise act in a manner which will favour one team over the other. If the momentum of the rolling plaything is fairly high, the magnets 31 may pass over a number of the inserts 19 with only a slight hesitation due to the magnetic attraction but this will also influence the movement of the device and make it harder to propel or to judge as the players try to intercept the ball and deflect its course.

Referring now to the FIG. 2 embodiment of the present invention, a plaything is shown as comprising an outer ball 42 which preferably is formed of a suitable plastic material. The ball 42 is shown constructed of two semi-spherical halves joined together in an appropriate manner. An inner surface 44 of the ball is provided with integrally formed deflectors 46, there being one such frusto-conical deflector on each of the ball halves. The inwardly-projecting and diametrically-opposed deflectors 46 are fitted with inserts 47 of a suitable magnetic material.

A heavily weighted ball 50 is enclosed within the outer ball 42 and this inner ball is fitted with at least two permanent magnets 51. If desired, other such magnets (not shown) may be fitted into the ball 50 so that the pole pieces of all magnets appear on peripheral surface 52 of the inner ball.

When the ball 42 is rolled over the ground, the inner ball 50 rolls about the surface 44 and occasionally comes into contact with the deflectors 46. Thus, the number of possible free paths of travel for the inner ball is reduced by the presence of the deflectors. The ball 50 is deflected from one side of the outer ball to the other and, because of the considerable weight of the inner ball, the rolling action of the plaything is irregular, jerky and therefore difficult for a player to anticipate. At times, the inner ball 50 will come into contact with one of the deflectors in such a position that a magnet 51 engages an insert 47 whereupon the inner ball momentarily is locked or fixed to the outer ball and the movement of the outer ball is interfered with even more than before. The magnetic attraction between the two elements 51 and 47 is not great enough to hold the inner ball permanently affixed to the deflector and the inner ball eventually will be shaken loose to continue ricocheting and rolling about the interior of the outer ball as the latter ball is pushed or knocked one way or the other.

FIG. 3 shows an embodiment of the invention which comprises a hollow body or ball 60 having a tough, flexible cover 61 and a relatively thick, sponge rubber liner 62. A valve 64 is fitted to the liner and is accessible through a cover opening 65 whereby the interior of the ball can be filled with pressurized air or gas. The liner 62 has an inner surface 66 which is provided with diametrically opposing pockets 67. These pockets lead to magnetic inserts 68 suitably secured to the cover 61.

The ball 60 is fitted with a weighted ball 70, this smaller ball being provided with permanent magnets 71. At least two such magnets are carried on opposite sides of the inner ball 70 and, should additional magnets be provided, they are suitably spaced about peripheral surface 72 of the ball.

When the outer ball 60 is rolled along the ground or other playing surface, the inner ball 70 will travel around the surface 66 and on occasions will drop into a pocket 67. The magnetic members 68 and 71 will sometimes engage so that the inner ball is held in the pocket for a short time at least and this overbalances the plaything so that it does not behave as expected.

FIG. 4 illustrates still another embodiment of the present invention. This embodiment comprises an outer ball 76 which has a peripheral wall 77 formed of a suitable flexible material. The wall 77 has a valve 78 which allows the ball to be inflated as before. Inner surface 80 of the wall 77 is fitted with appropriately spaced magnetic inserts 81 which preferably are flush with that surface so as not to interfere with the rolling motion of an inner ball 84.

The inner ball 84, of course, normally is capable of rolling freely around inner surface 80 of the outer ball. This weighted ball 84 is hollowed out to provide a central chamber 86. A hollow, spherical casing 87 is mounted in the central chamber 86 and the contents of this casing, which will be described later, are protected from shock by a layer 88 of a suitable cushioning material. The inner ball 84 is provided with radial openings 90 each of which house an antenna 91 extending outwardly from the casing 87. These openings 90 are appropriately spaced around the inner ball and each opening is fitted with a battery 93 and an electromagnet 94.

The FIG. 5 diagram shows a small, portable radio transmitter 96 which has an antenna 97. A control switch 98 preferably of the push-type button type, is provided on the transmitter casing. When the switch is closed, a radio signal represented at 99 in FIG. 5 is sent out by the transmitter and is picked up by a miniaturized receiver 105 which is shown only in the FIG. 5 diagram.

The receiver 105 is housed within the hollow casing 87 carried by the inner ball and the several antennas 91 are appropriately connected into the circuitry of this receiver although only one such antenna is shown in the diagram. The receiver circuit also includes a relay 107 having an armature 108 which swings between contacts 109 and 110. For sake of clarity, only two of the batteries 93 and two electromagnets 94 are shown in the FIG. 5 diagram but it will be understood all the remaining electromagents and batteries are similarly interconnected in series.

The ball 76 can be rolled relatively freely over a playing surface as long as the electromagnets 94 are not energized. At such time, the small ball 84 will roll about the inner spherical surface 80 and will change the weight distribution of the outer ball so as to make its movement irregular as compared to a conventional soccer ball, for example. A person operating the transmitter 96 watches the movement of the ball closely and, at an appropriate moment such as when the ball is moving away from a player or players, presses the control switch 98. A radio signal is sent by the transmitter and is picked up by the receiver 105 carried by the inner ball. Of course, the material used to construct the wall 77 of the outer ball is one which will allow the radio signals to pass therethrough. An amplified signal is fed to the relay 107 and the energized relay closes the armature 108 to the contact 109 whereupon the several batteries 93 energize all of the electromagnets 94. The ball 84 is magnetically attracted to the inserts 81 so as to decelerate the rolling movements of both the outer and inner balls. Eventually, the inner ball will come to a stop when one of the electromagnets attaches itself to an insert. The outer ball is then overbalanced and will remain so until the operator releases the control switch 98 to deenergize all the electromagnets 94.

FIGS. 6 and 7 show an elongated embodiment of the present invention. This plaything comprises a hollow cylinder generally indicated at 120. The cylinder has a rubber cover 122 enclosing a metal liner 123. The cylinder 120 also has a center portion 125 which connects two identical end sections 126. A radio receiver 128 is mounted within the center portion and this receiver is provided with a suitable number of antennas 129. The ends sections 126 each have screened openings 132. One of the previously described small balls 84 used in the FIG. 4 embodiment is enclosed in each of the end sections 126.

The cylindrical plaything is intended to be pushed over the surface of a playing field by a team racing against the clock, or by two opposing teams playing a game having regulation periods and so on and, at times, the device is controlled to some degree by means of the radio transmittor 96. The balls 84 will roll freely and overbalance the rotating cylinder 120 as long as the electromagnets 94 are de-energized but closing of the switch 98 will magnetically attach some of the electromagnets 94 to the metal liner within the end sections 126 and a different rolling action of the cylindrical plaything will result. The openings 132 allow the radio signals to penetrate to the interiors of the end sections so as to be picked up by the antennas 129.

From the foregoing, it will be apparent there is provided a number of playthings which can be used to play not only organized games but which serve as an exercising device for atheletes. A trainer standing on the sidelines and using the portable radio has some measure of control over the receiver-equipped plaything and can vary the exercises as he sees fit by means of shouted orders.

I claim:

1. A rollable plaything comprising a hollow outer ball having an inner surface, magnetic means on the inner surface, a relatively small and heavy inner ball enclosed within the outer ball and having a peripheral surface, diametrically opposed electromagnets mounted on the inner ball substantially flush with the peripheral surface, said inner surface providing the inner ball with a multitude of circular paths of travel when rolling motion is imparted to the outer ball, circuit means within the inner ball including a battery and a signal-operated switch both electrically connected to each electromagnet, and a manually operable device for transmitting signals from a remote location whereby to close the signal-operated switch and energize the electromagnets.

2. A rollable plaything comprising a hollow cylinder having an inner cylindrical surface, magnetic means associated with the inner cylindrical surface, a relatively small and heavy ball mounted in the hollow cylinder and having a spherical surface, said ball being adapted to roll around the inner cylindrical surface when the hollow cylinder is rotated about the longitudinal axis thereof, an electromagnet mounted on the ball and having a pole piece magnetically exposed on the peripheral surface, circuit means including a battery and a signal-operated switch both electrically connected to the electromagnets, and a manually operable device for transmitting signals from a remote located whereby to actuate the circuit means and energize the electromagnet.

3. A rollable plaything as claimed in claim 2, in which said magnet means comprises a metal liner for the hollow cylinder said metal liner having openings providing access for the transmitted signals.

4. A rollable plaything adapted to be propelled over a playfield in a team game and comprising a hollow body having outer and inner surfaces; said outer surface having a smooth, uninterrupted, circular circumference allowing unimpeded rolling movement; a weighted ball enclosed within the hollow body and having a spherical and smooth peripheral surface, said inner surface providing a multitude of depression-free paths of travel around which the weighted ball normally rolls in response to rolling movement of the hollow body, a plurality of magnetic elements mounted on the weighted ball substantially flush with the peripheral surface and spaced apart thereon, a plurality of magnetic members set into and substantially flush with the inner surface adapted to be attracted to the magnetic elements as the weighted ball rolls around the inner surface when the hollow body is propelled whereby the speed and direction of both the weighted ball and the hollow body are influenced by magnetic attraction.

5. A rollable plaything as claimed in claim 4, in which said magnetic element is an electromagnet, said weighted ball being fitted with circuit means including a battery and a signal-operated switch both electrically connected to the electromagnet, and a manually operable device for transmitting signals from a remote location whereby to actuate the circuit means and energize the electromagnets.

6. A rollable plaything as claimed in claim 4, in which each of said magnetic elements is a permanent magnet, and each of said magnetic members is an insert of magnetic material.

7. A rollable plaything as claimed in claim 4, in which said inner surface has diametrically opposed, inwardly-projecting and substantially frusto-conical deflectors arranged to deflect the weighted ball from some paths of travel.

8. A rollable plaything as claimed in claim 7, in which said magnetic members are located on the opposing deflectors.

* * * * *